US007062920B2

(12) United States Patent
McMasters et al.

(10) Patent No.: US 7,062,920 B2
(45) Date of Patent: Jun. 20, 2006

(54) COMBUSTOR DOME ASSEMBLY OF A GAS TURBINE ENGINE HAVING A FREE FLOATING SWIRLER

(75) Inventors: Marie Ann McMasters, Mason, OH (US); James Edward Thompson, Middletown, OH (US); Gregory Allen Cimmarusti, Mason, OH (US); James Neil Cooper, Hamilton, OH (US); Glenn Edward Wiehe, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 199 days.

(21) Appl. No.: 10/638,597

(22) Filed: Aug. 11, 2003

(65) Prior Publication Data

US 2005/0034460 A1 Feb. 17, 2005

(51) Int. Cl.
*F23R 3/60* (2006.01)

(52) U.S. Cl. ..... 60/800; 60/748

(58) Field of Classification Search ..... 60/748, 60/756, 799, 800, 804
See application file for complete search history.

(56) References Cited

U.S. PATENT DOCUMENTS 3,703,259 A * 11/1972 Sturgess et al. ..... 60/748
4,763,482 A 8/1988 Wehner ..... 60/746
5,865,024 A * 2/1999 Kress et al. ..... 60/748
5,916,142 A 6/1999 Snyder et al. ..... 60/748
6,134,877 A * 10/2000 Alkabie ..... 60/800
6,314,739 B1 11/2001 Howell et al. ..... 60/748
6,363,726 B1 4/2002 Durbin et al. ..... 60/748
6,381,964 B1 5/2002 Pritchard, Jr. et al. ..... 60/746
6,418,726 B1 7/2002 Foust et al. ..... 60/776
6,427,435 B1 8/2002 Patterson et al. ..... 60/39.32
6,453,671 B1 9/2002 Leen et al. ..... 60/748
6,484,489 B1 11/2002 Foust et al. ..... 60/39.06
6,571,559 B1 6/2003 Fortuna et al. ..... 60/748

* cited by examiner

*Primary Examiner*—Louis J. Casaregola
(74) *Attorney, Agent, or Firm*—William Scott Andes; James P. Davidson, Esq.

(57) ABSTRACT

A combustor dome assembly for a gas turbine engine having a longitudinal centerline axis extending therethrough, including: an annular dome plate having an inner portion, an outer portion, a forward surface and a plurality of circumferentially spaced openings formed therein, wherein a radial section is defined between adjacent openings; an annular outer cowl connected to the outer portion of the dome plate; an annular inner cowl connected to the inner portion of the dome plate; and, a swirler located between the forward surface of the dome plate and the inner and outer cowls in substantial alignment with each of the openings in the dome plate. Each swirler further includes a forward portion and an aft portion and is retained by at least one tab member located upstream thereof so as to be movable in a radial and axial direction.

15 Claims, 6 Drawing Sheets

COMBUSTOR DOME ASSEMBLY OF A GAS TURBINE ENGINE HAVING A FREE FLOATING SWIRLER

BACKGROUND OF THE INVENTION

The present invention relates generally to a combustor dome assembly for a gas turbine engine and, in particular, to a combustor dome assembly having a plurality of free floating swirlers which are retained in position between the dome plate and the inner and outer cowls so that each swirler is able to receive a fuel nozzle and be movable radially and axially in conjunction therewith.

It is well known within the combustor art of gas turbine engines that a dome portion, in conjunction with inner and outer liners, serves to form the boundary of a combustion chamber. A mixture of fuel and air is ignited and burned in such combustion chamber so that the products thereof are able to interface with the blades of turbines and produce work through one or more shafts. The annular combustor dome also serves to position a plurality of mixers in a circumferential manner so that a fuel/air mixture is provided to the combustion chamber in a desired manner.

Gas turbine combustors typically require a floating ferrule or primary swirler to prevent air leakage into the combustor and still allow for thermal growths of the combustor, combustion casing and fuel nozzles. This requirement has oftentimes been accomplished by brazing a secondary swirler or pad into the dome and using a welded retainer to hold the floating ferrule or primary swirler in place. It will be appreciated that the location of such components is critical to the combustor performance and functionality. Examples of such an arrangement are disclosed in U.S. Pat. No. 6,427,435 to Patterson et al. and U.S. Pat. No. 6,314,739 to Howell et al.

While the typical combustor arrangement has adequate space between swirler cups to incorporate features to enhance the spectacle plate structure (e.g., the addition of ribs, cooling holes and the like), certain geometric restrictions have been introduced by current combustor designs which run lean so as to minimize emissions. As disclosed in U.S. Pat. No. 6,381,964 to Pritchard, Jr. et al., one particular fuel/air mixer configuration includes a fuel nozzle which contains a pilot mixer therein. The fuel nozzle is then located within a main mixer. Accordingly, the size of the fuel nozzle and the corresponding swirler assembly associated therewith, has increased significantly from those previously utilized and thereby reduced the distance between adjacent swirler cups. Utilization of an annular dome plate having a greater diameter would serve to increase the weight of the engine and require modification of components interfacing therewith. Thus, the openings in the dome plate have been enlarged and thereby lessened the circumferential distance between adjacent openings.

Thus, in light of the foregoing, it would be desirable for a combustor dome assembly to be developed which accommodates minimum spacing between adjacent swirler cups. It would also be desirable to simplify such a combustor dome assembly and reduce the amount of components needed while maintaining its intended functionality. Improvements in the area of producibility, maintainability and serviceability are likewise desired.

BRIEF SUMMARY OF THE INVENTION

In a first exemplary embodiment of the invention, a combustor dome assembly for a gas turbine engine is disclosed as having a longitudinal centerline axis extending therethrough. The combustor assembly includes: an annular dome plate having an inner portion, an outer portion, a forward surface and a plurality of circumferentially spaced openings formed therein, wherein a radial section is defined between adjacent openings; an annular outer cowl connected to the outer portion of the dome plate; an annular inner cowl connected to the inner portion of the dome plate; and, a swirler located between the forward surface of the dome plate and the inner and outer cowls in substantial alignment with each of the openings in the dome plate. Each swirler further includes a forward portion and an aft portion and is retained by at least one tab member located upstream thereof so as to be movable in a radial and axial direction.

In a second exemplary embodiment of the invention, an annular cowl for a gas turbine engine combustor having a longitudinal centerline axis therethrough is disclosed, where the combustor includes an annular dome plate having an inner portion, an outer portion, a forward surface and a plurality of circumferentially spaced openings formed therein. The cowl includes a downstream end connected to one of the inner and outer portions of the dome plate, an upstream end positioned upstream of the forward surface for the dome plate, and a plurality of circumferentially spaced tab members extending from an inner surface of the upstream end. The tab members serve to retain a corresponding swirler between the cowl and the dome plate in a free floating manner while maintaining substantial alignment with one of the openings in the dome plate.

DETAILED DESCRIPTION OF THE INVENTION

Figure 1:
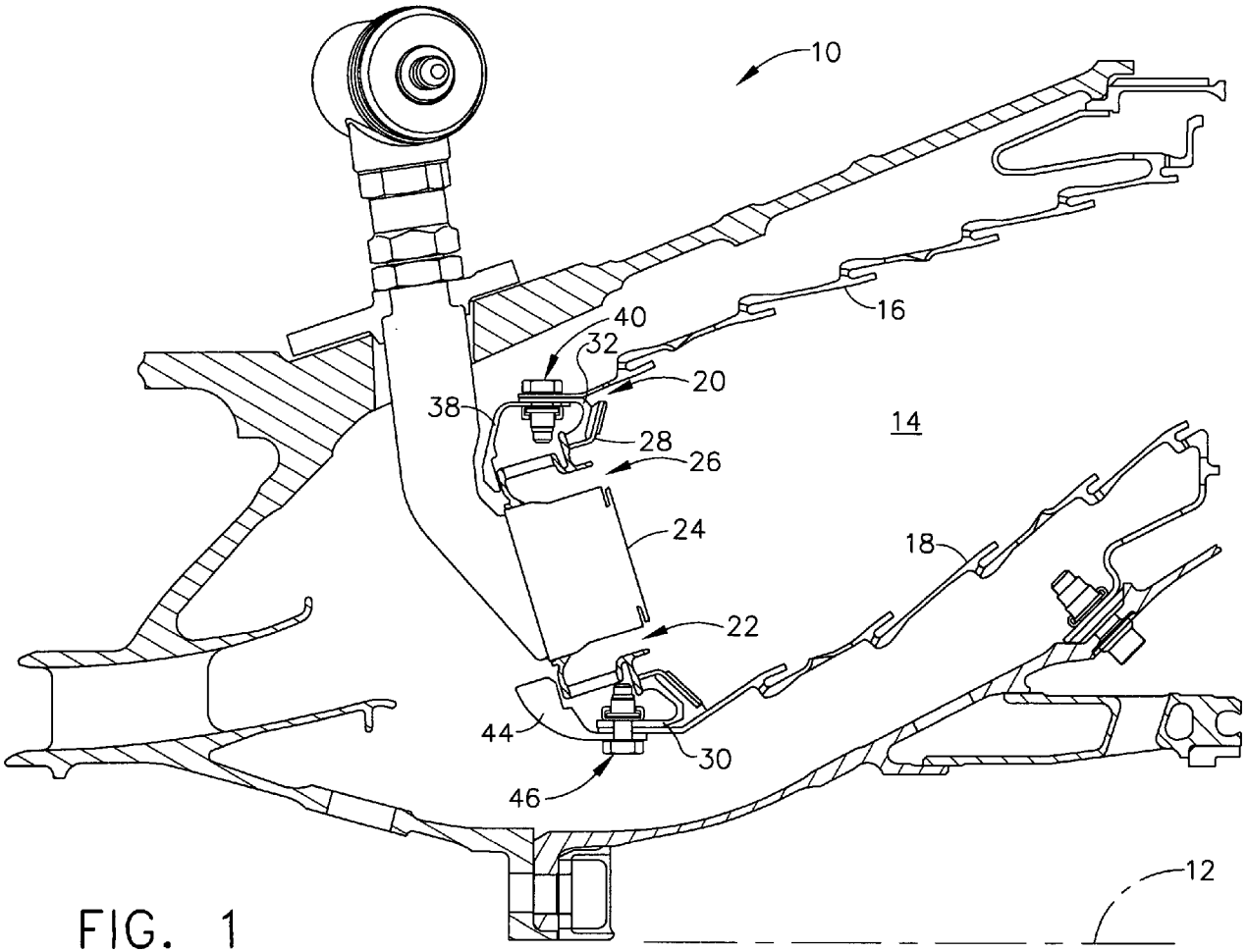
FIG. 1 is a cross-sectional view of a gas turbine engine combustor including a combustor dome assembly of the present invention.

Referring now to the drawings in detail, wherein identical numerals indicate the same elements throughout the figures, FIG. 1 depicts an exemplary gas turbine engine combustor 10 having a longitudinal centerline axis 12 extending therethrough. Combustor 10 includes a combustion chamber 14 defined by an outer liner 16, an inner liner 18, and a dome plate 20 located at an upstream end thereof. It will be understood that a plurality of fuel/air mixers 22 are circumferentially spaced within dome plate 20 so as to introduce a mixture of fuel and air into combustion chamber 14, where it is ignited by an igniter (not shown) and combustion gases are formed which are utilized to drive one or more turbines downstream thereof. More specifically, each air/fuel mixer 22 preferably includes a fuel nozzle 24, a swirler 26, and a deflector plate 28.

Figure 5:
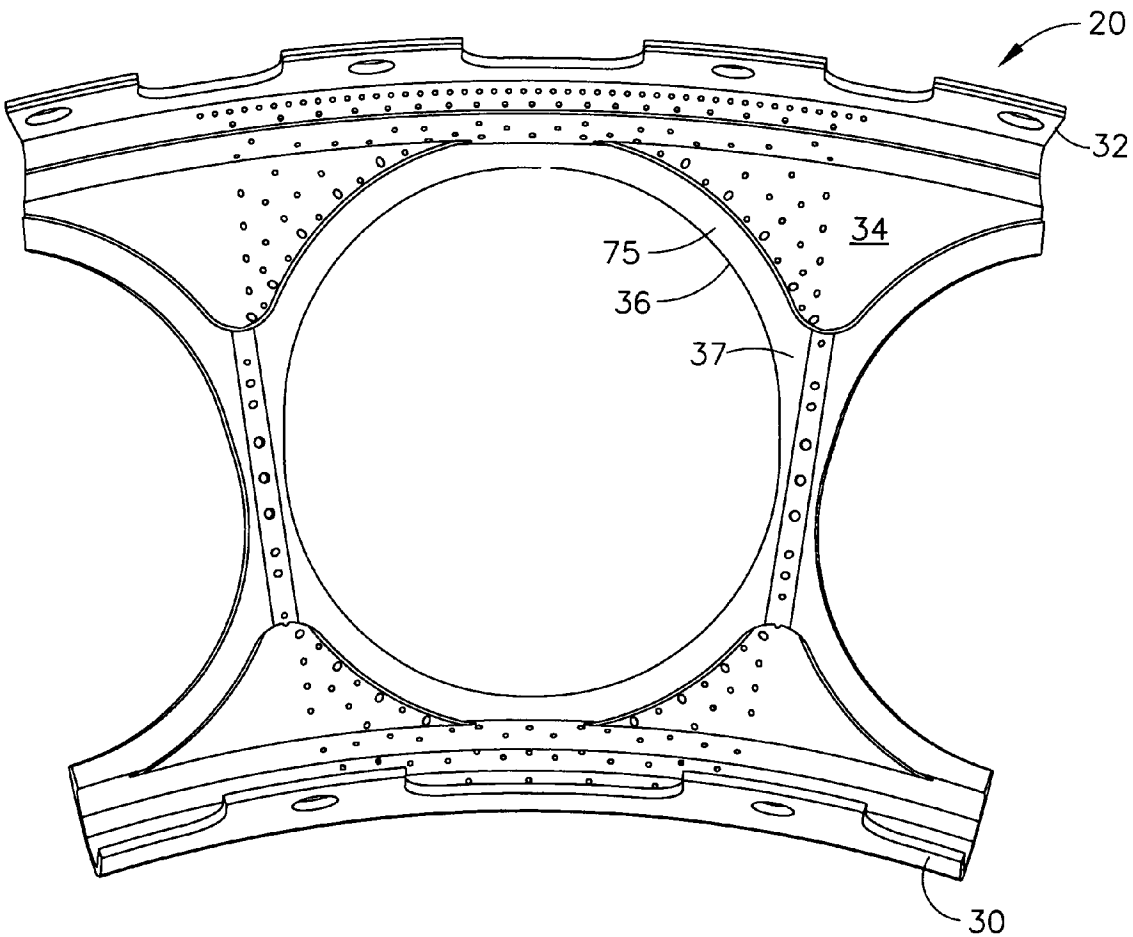
FIG. 5 is an enlarged, partial aft view of the dome plate for the combustor dome assembly depicted in FIGS. 1 and 2; and, FIG. 6 is an enlarged, partial cross-sectional view of an alternative embodiment for the combustor dome assembly of the present invention.

More specifically, it will be understood that dome plate 20 is annular in configuration and includes an inner portion 30, an outer portion 32, a forward surface 34 and a plurality of circumferentially spaced openings 36 formed therein (see FIG. 5). Accordingly, a radial section 37 is defined between each adjacent opening 36 in dome plate 20. An annular outer cowl 38 is preferably affixed to outer portion 32 of dome plate 20 at a downstream end 39, as well as to outer liner 16, by means of a plurality of connections 40 (e.g., bolts and nuts). Similarly, an annular inner cowl 44 is preferably affixed to inner portion 30 of dome plate 20 at a downstream end 45, as well as to inner liner 18, by means of a plurality of connections 46 (bolts and nuts).

Each swirler 26 is located between forward surface 34 of dome plate 20 and upstream ends 47 and 49 of outer and inner cowls 38 and 44, respectively, so as to be in substantial alignment with an opening 36 in dome plate 20. Further, each swirler 26 preferably includes a forward portion 50 and an aft portion 52. It will be appreciated that swirlers 26 are not fixed or attached to any other component of air/fuel mixer 22, but are permitted to float freely in both a radial and axial direction with respect to a centerline axis 53 through each opening 36. Each swirler 26 preferably includes vanes 48 therein which are oriented to provide swirl in a substantially radial direction with respect to centerline axis 53.

It is desirable, however, that swirlers 26 be retained in position between dome plate 20 and cowl upstream ends 47 and 49 so that fuel nozzles 24 may be desirably received therein. Accordingly, at least one tab member is provided upstream of each swirler 26 to restrict radial and axial movement thereof to a predetermined amount. Preferably, it will be noted that a first tab member 54 and a second tab member 56 are located upstream of each swirler 26 at approximately a radially outer position and a radially inner position, respectively. As seen in FIGS. 1–4, first tab members 54 are preferably associated with a surface 35 of outer cowl 38. Likewise, second tab members 56 are preferably associated with a surface 43 of inner cowl 44. In such case, first and second tab members 54 and 56 may be attached to their respective cowl (e.g., via brazing or the like) and/or formed integrally therewith (via forging and machining operations). It will be appreciated that the presence of tab members 54 and 56 and the spacing therebetween functions to detune cowls 38 and 44, respectively, and thereby improve the frequency margin thereof.

Figure 2:
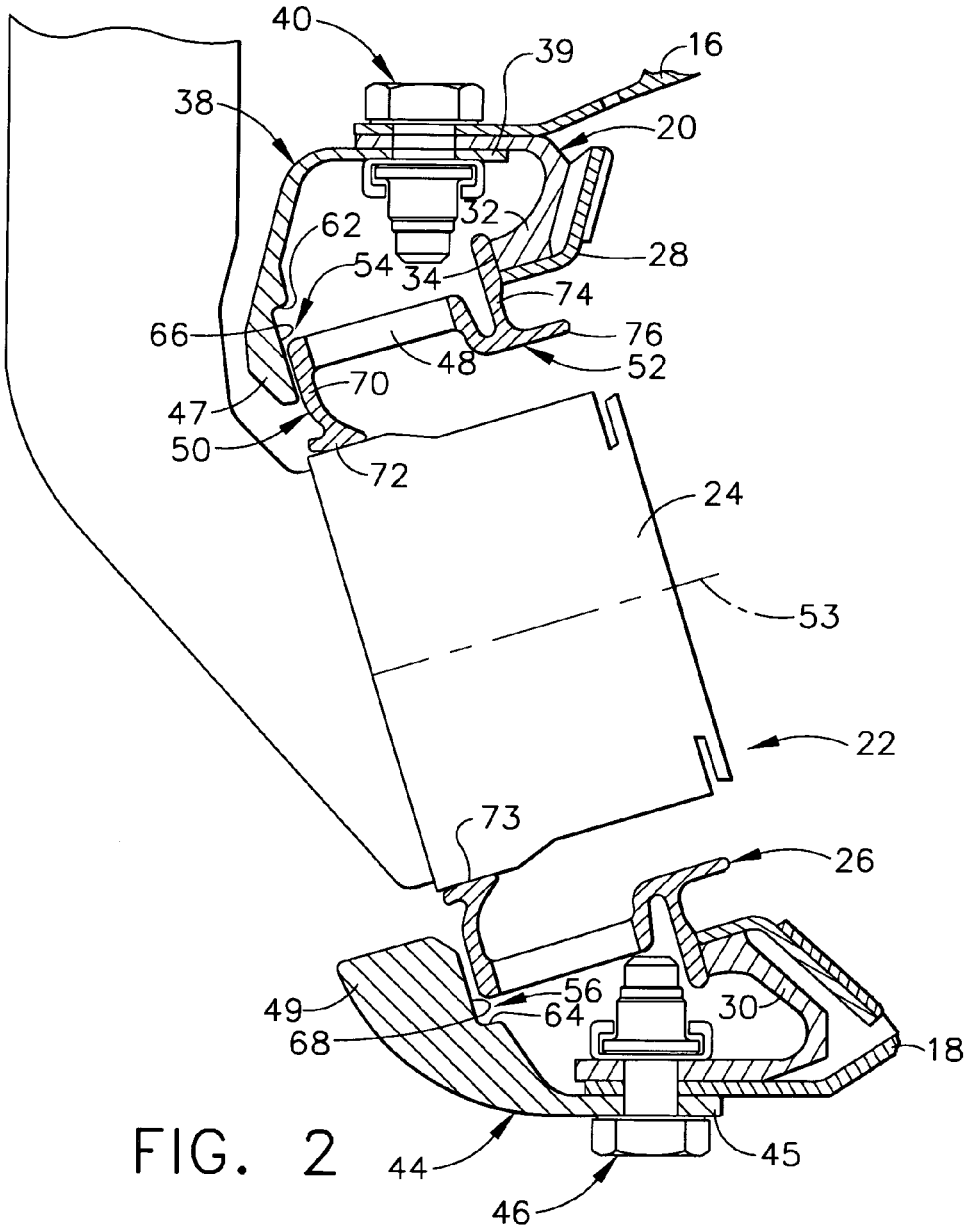
FIG. 2 is an enlarged, partial cross-sectional view of the combustor dome assembly depicted in FIG. 1.
Figure 3:
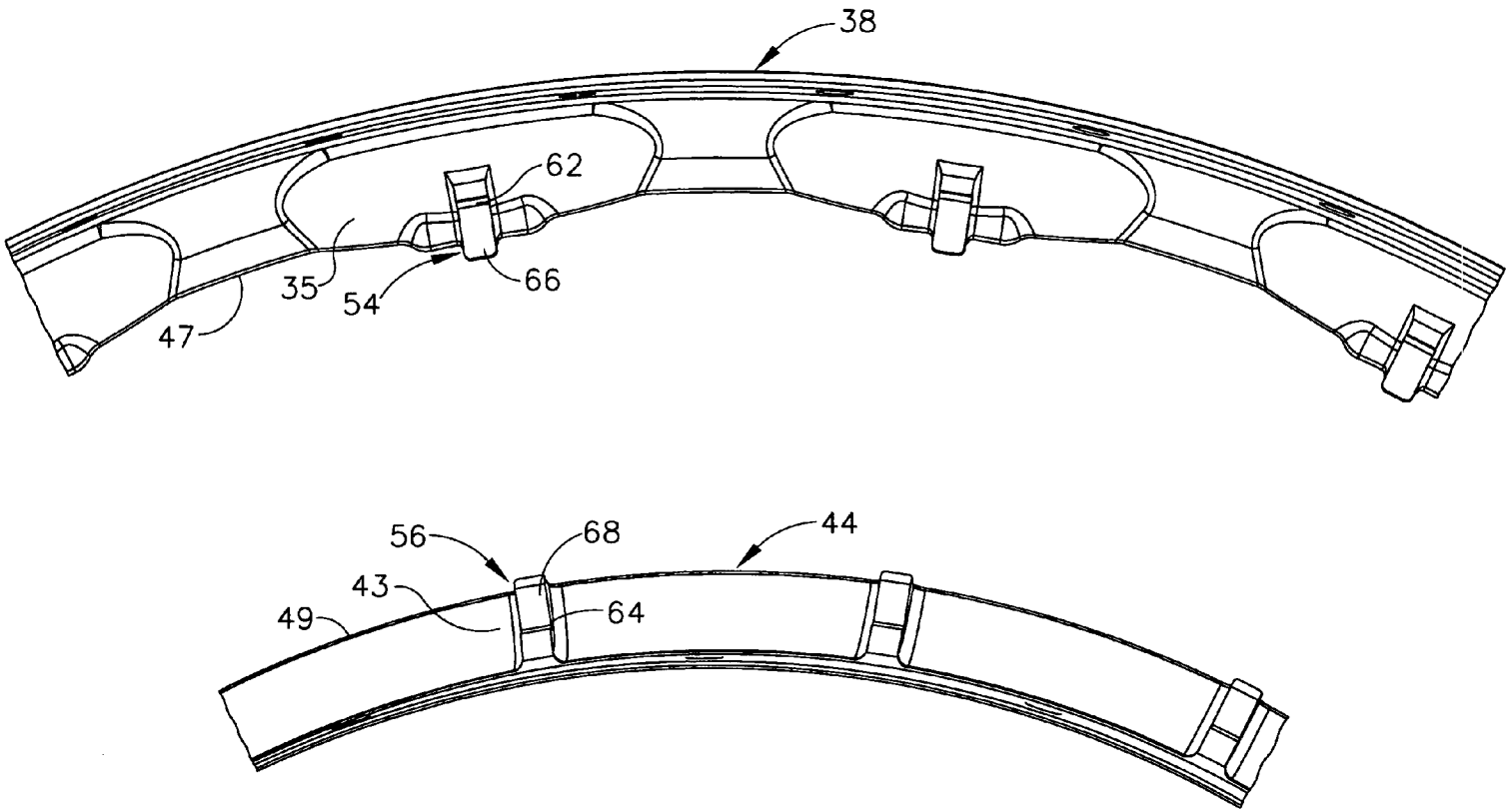
FIG. 3 is an enlarged, partial aft view of the inner and outer cowls of the combustor dome assembly depicted in FIGS. 1 and 2.
Figure 4:
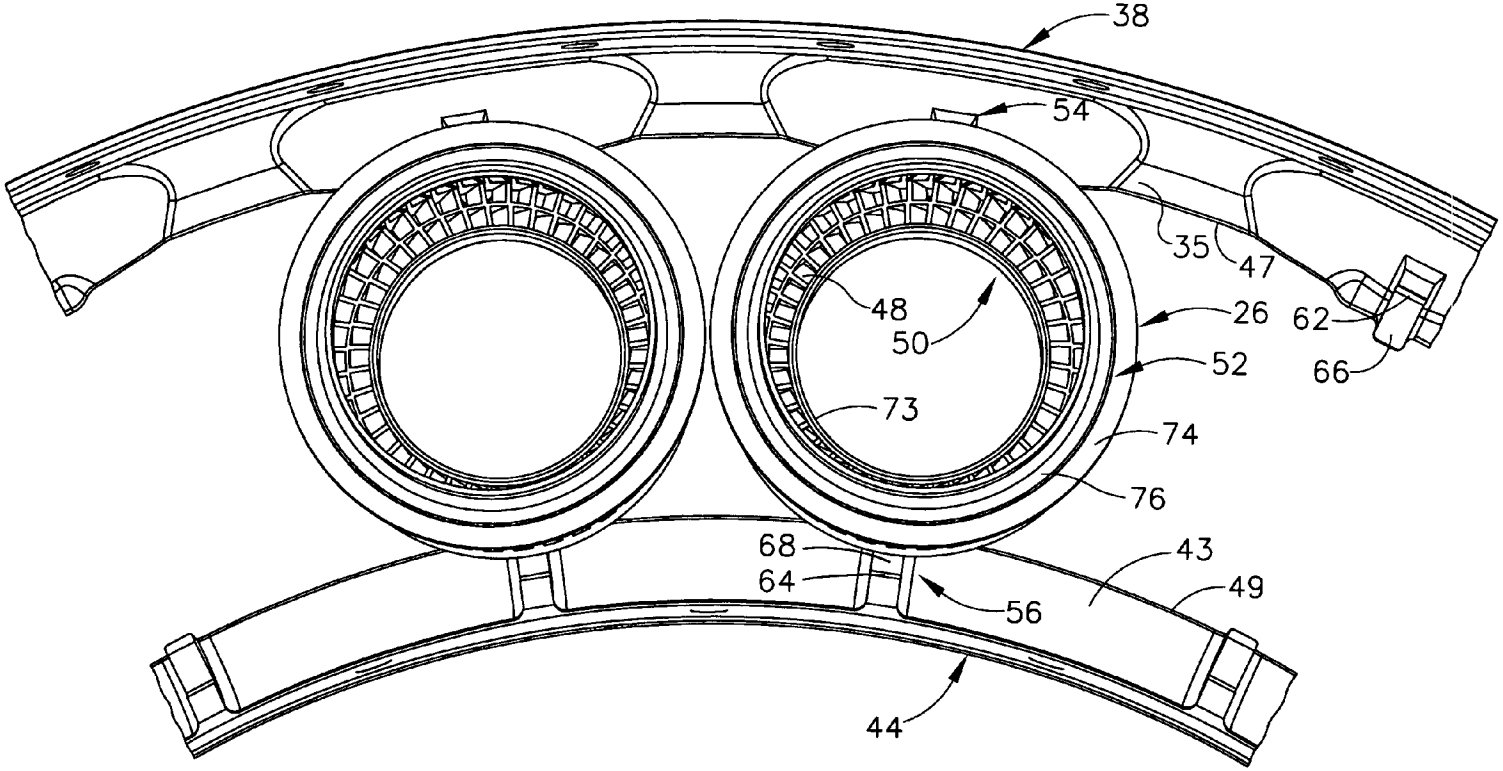
FIG. 4 is an enlarged, partial aft view of the swirlers and the inner and outer cowls of the combustor dome assembly depicted in FIGS. 1 and 2.

As best seen in FIGS. 2 and 3, first tab members 54 and second tab members 56 preferably include an axial surface 62 and 64, respectively, associated therewith for accommodating a predetermined amount of radial growth and movement by swirler forward portion 50 therebetween. First and second tab members 54 and 56 also preferably include a radial surface 66 and 68, respectively, associated therewith and spaced from dome plate forward surface 34 a predetermined amount for accommodating axial growth and movement by swirler 26. It will be appreciated that the amount of axial movement is limited to prevent swirlers 26 from wedging themselves in a position which is misaligned with their respective dome plate opening 36. In this regard, it will be seen that swirler forward portion 50 preferably includes a radial flange 70 which moves between axial surfaces 62 and 64 of first and second tabs 54 and 56 and interfaces with radial surfaces 66 and 68. Swirler forward portion 50 also preferably includes an axial section 72 which receives fuel nozzle 24 in an inner surface 73 thereof.

Figure 6:
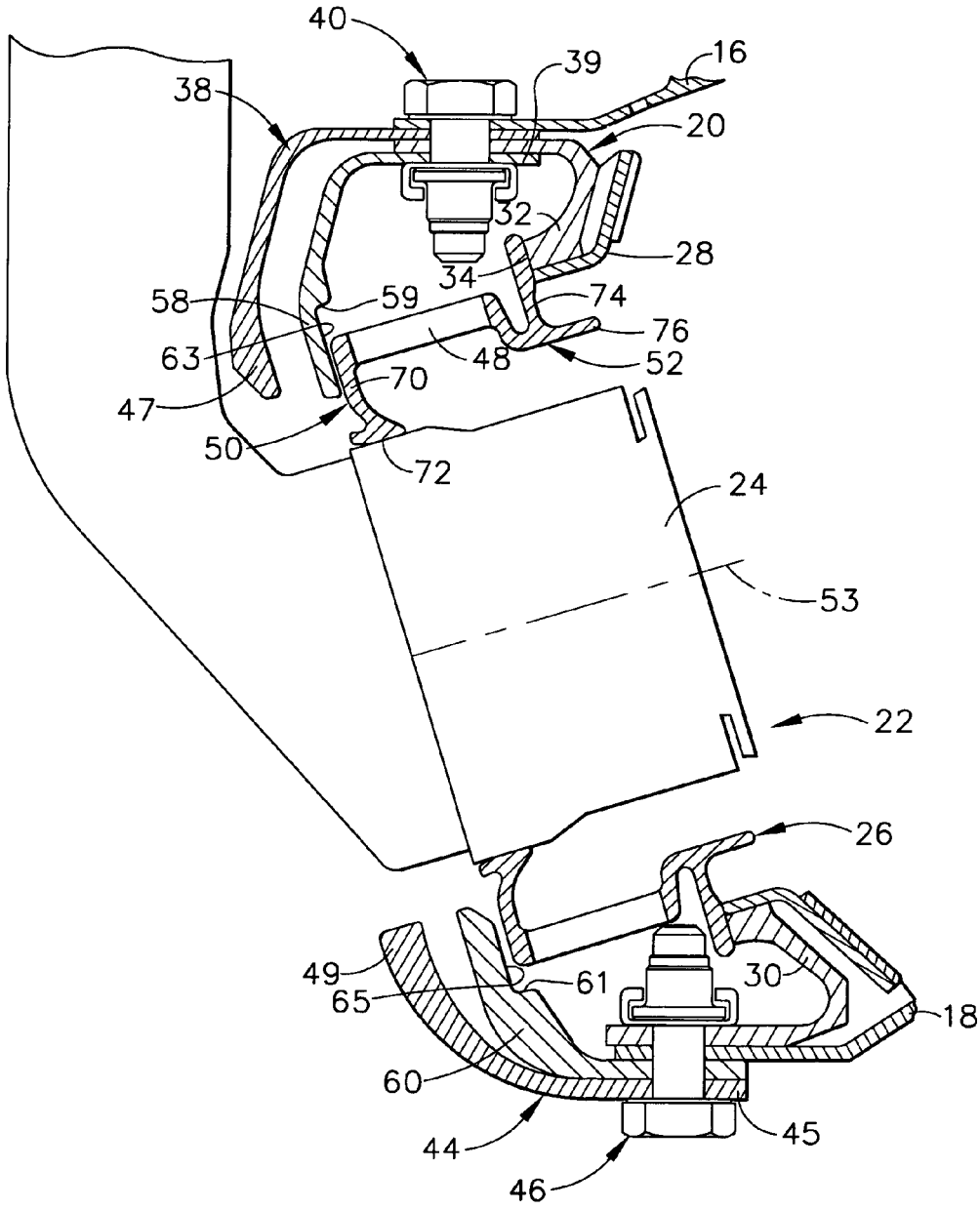

Alternatively, as seen in FIG. 6, separate tab members 58 may be connected to dome plate outer portion 32, outer liner 16, and outer cowl downstream end 39 via connectors 40. Similarly, tab members 60 may be connected to dome plate inner portion 30, inner liner 18, and inner cowl downstream end 45 via connectors 46. Tab members 58 and 60 each preferably include an axial surface 59 and 61, respectively, as well as a radial surface 63 and 65, which function as described above with respect to tab members 54 and 56.

Swirler aft portion 52 preferably includes a flange 74 which is able to slide radially along a boss portion 75 of dome plate forward surface 34. A lip 76 is connected to flange 74 and is preferably oriented substantially perpendicular to flange 74 so that it is substantially parallel to centerline axis 53. It will be noted that lip 76 extends aft of dome plate forward surface 34 so that it interfaces with deflector plate 28 to limit radial movement of swirler aft portion 52.

Fuel nozzle 24 is preferably of the type disclosed in U.S. Pat. No. 6,381,964 to Pritchard, Jr. et al., which is hereby incorporated by reference. It will be appreciated that fuel nozzle 24 is larger than typical fuel nozzles and therefore requires larger openings in dome plate 20. It will be understood that one feature of free floating swirlers 26 is the ability to move with fuel nozzles 24 during operation of the gas turbine engine. Further, swirlers 26 are able to be adjusted when fuel nozzles 24 are inserted therein. In this regard, tab members 54 and 56 are configured to provide an adequate clearance with fuel nozzles 24.

Other advantages are also associated with the combustor dome assembly of the present invention. For example, producibility of the combustor dome assembly is improved since a braze and weld operation at each swirler is eliminated. Moreover, inspection of the braze joint connecting deflector plates 28 to dome plate 20 is enhanced. Since the number of components in the combustor dome assembly is reduced, maintainability of swirlers 26 is improved. Because swirlers 26 can be removed simply by unbolting one of cowls 38 or 44 via connectors 40 or 46, respectively, the time and effort required for performing maintenance and the like is reduced.

Having shown and described the preferred embodiment of the present invention, further adaptations of the combustor and the dome thereof can be accomplished by appropriate modifications by one of ordinary skill in the art without departing from the scope of the invention.

What is claimed is:

1. A combustor dome assembly for a gas turbine engine having a longitudinal centerline axis extending therethrough, comprising:

(a) an annular dome plate having an inner portion, an outer portion, a forward surface and a plurality of circumferentially spaced openings formed therein, wherein a radial section is defined between each adjacent opening;

(b) an annular outer cowl connected to said outer portion of said dome plate;

(c) an annular inner cowl connected to said inner portion of said dome plate; and, (d) a swirler located between said forward surface of said dome plate and said inner and outer cowls in substantial alignment with each of said openings in said dome plate; said swirler including:

(1) a forward portion and an aft portion; and, (2) at least one tab located upstream of each said swirler for retaining said swirler with respect to said dome plate;

wherein each said swirler is retained in a manner so as to be movable it a radial and axial direction.

2. The combustor dome assembly of claim 1, further comprising a first tab and a second tab located upstream of each said swirler for retaining said swirler with respect to said dome plate.

3. The combustor dome assembly of claim 2, wherein said first tabs are connected to said outer cowl and said second tabs are connected to said inner cowl.

4. The combustor dome assembly of claim 2, wherein said first tabs are formed integrally with said outer cowl and said second tabs are formed integrally with said inner cowl.

5. The combustor dome assembly of claim 2, wherein said first tabs are connected to said dome plate outer portion and said second tabs are connected to said dome plate inner portion.

6. The combustor dome assembly of claim 2, said first and second tabs each including an axial surface associated therewith for accommodating a predetermined amount of radial growth and movement by each said swirler forward portion therebetween.

7. The combustor dome assembly of claim 2, said first and second tabs each including an radial surface associated therewith and spaced from said dome plate forward surface for accommodating a predetermined amount of axial growth and movement by each said swirler.

8. A combustor dome assembly for a gas turbine engine having a longitudinal centerline axis extending therethrough, comprising:

(a) an annular dome plate having an inner portion, an outer portion, a forward surface and a plurality of circumferentially spaced openings formed therein, wherein a radial section is defined between each adjacent opening;

(b) an annular outer cowl connected to said outer portion of said dome plate;

(c) an annular inner cowl connected to said inner portion of said dome plate;

(d) a swirler located between said forward surface of said dome plate and said inner arid outer cowls in substantial alignment with each of said openings in said dome plate, said swirler including a forward portion and an aft portion, wherein each said swirler is retained in a manner so as to be movable in a radial and axial direction; and (e) a deflector plate connected to and positioned within each opening in said dome plate, each said swirler aft portion including a lip which limits radial movement of each said swirler by engaging said deflector plate.

9. The combustor dome assembly of claim 1, further comprising a fuel nozzle positioned within a surface of each swirler, wherein each said swirler moves in conjunction with said fuel nozzle.

10. The combustor dome assembly of claim 1, said swirler aft portion including a flange which moves radially along said forward surface of said dome plate.

11. The combustor dome assembly of claim 1, wherein each said swirler includes vanes therein which are oriented to provide swirl in a substantially radial direction with respect to centerline axis through its associated dome plate opening.

12. The combustor dome assembly of claim 2, said swirler forward portion including a radial section which moves between said first and second tabs.

13. The combustor dome assembly of claim 2, said swirler forward portion including an axial section for receiving a fuel nozzle.

14. The combustor dome assembly of claim 1, further comprising an outer line connected to said dome plate outer portion and said outer cowl.

15. The combustor dome assembly of claim 1, further comprising an inner liner connected to said dome plate inner portion and said inner cowl.

* * * * *